United States Patent [19]

Ethridge

[11] Patent Number: 4,985,947

[45] Date of Patent: Jan. 22, 1991

[54] PATIENT ASSIST DEVICE

[76] Inventor: Kenneth L. Ethridge, Rte. 1, Box 139, Bee Branch, Ark. 72013

[21] Appl. No.: 522,670

[22] Filed: May 14, 1990

[51] Int. Cl.[5] ..... A61G 7/14; A61G 7/10

[52] U.S. Cl. ..... 5/81 R; 272/70.3

[58] Field of Search ..... 5/81 R, 81 B, 86, 83; 272/70.3, 70.4; 135/67; 404/921

[56] References Cited

U.S. PATENT DOCUMENTS

| | | | |
|---|---|---|---|
| 3,165,314 | 1/1965 | Clearman et al. | 5/81 R |
| 3,189,345 | 6/1965 | Simpson | 5/81 R |
| 3,553,746 | 1/1971 | Seiger | 5/503 |
| 3,591,874 | 7/1971 | O'Kennedy | 5/503 |
| 3,596,298 | 8/1971 | Durst, Jr. | 5/81 R |
| 3,999,228 | 12/1976 | Thomas | 5/81 R |
| 4,510,956 | 4/1985 | King | 135/67 |
| 4,802,542 | 2/1989 | Houston et al. | 5/81 R |

*Primary Examiner*—Alexander Grosz
*Attorney, Agent, or Firm*—Stephen D. Carver

[57] ABSTRACT

A machine for assisting a partially ambulatory user to rise and move about. The wheeled frame comprises a rigid, U-shaped base which supports a pair of upwardly extending sides. The frame sides border an open front in which the user is received. Rigid hand rails associated with the frame sides and a push-handle associated with the frame rear may be grasped by the user for support. A cushioned yoke engages the user's torso to support body weight. The yoke may be interchanged with a custom yoke which conforms to the user's body. The yoke is pivotally coupled to a winch-driven linkage assembly comprising a pair of cooperating levers mounted for movement within the frame interior. The top and bottom levers pivot about pivot points defined by bearings coupled to the frame sides. The levers are of different lengths, and their pivot points are offset, so that the camber of the yoke varies during operation. The linkage assembly is driven by a battery-powered winch. Electrical switches associated with the yoke or the hand rails are conveniently accessed by the user to activate the winch. As the user rises from a seated position, the yoke undergoes camber loss until it reaches an intermediate position of maximum negative camber. Camber gain occurs as the yoke rises to its uppermost position of maximum positive camber. The user is thus comfortably and positively supported.

14 Claims, 2 Drawing Sheets

PATIENT ASSIST DEVICE

BACKGROUND OF THE INVENTION

The present invention relates broadly to devices for assisting injured or physically impaired persons to walk or move about. More particularly, the present invention relates to an automated lift device for assisting a partially ambulatory individual to rise from a chair, bed, or other support and to maneuver about without assistance from others.

Many physically disabled individuals cannot support their full body weight with their legs. However, mechanical devices may assist the injured or physically impaired in moving about their dwelling. For example, a person who is temporarily disabled by virtue of surgery or an accident, or one whose muscles have weakened during a period of long recovery from illness, may find it possible to move about with mechanical assistance. Mechanical locomotion assisting devices are beneficial to persons who have permanently lost the use of one or more bodily members, including those patients who use prosthetic devices. Extremely obese individuals who are unable to support their weight independently can also benefit from mechanical assistance.

Many such people who are partially ambulatory generally prefer to avoid wheelchairs. In order to maintain or regain leg muscle tone and strength, they must continue to exercise their legs by standing or walking. However, they must have help to rise up from a chair or bed to a standing position and usually must be supported to walk. For purposes of simplicity and clarity, all such individuals are collectively designated herein as the "patient", although many are not institutional "patients" in the strict sense of the word.

In an institutional setting, such as a nursing facility or hospital, partially ambulatory patients must await the assistance of busy aides or nurses to rise and move about. As a result, the patient often experiences inconvenient delays, or may be too rushed to enjoy meaningful leisure or privacy in moving about. Heavy or large patients typically experience increased difficulty and inconvenience, since more than one staff member may be required to safely lift the patient and support him for walking. Nursing home care usually does not facilitate proper exercise.

Partially ambulatory patients who care for themselves may use lifters, canes, or similar support devices to assist them to rise and move about. Various such support devices have been proposed in the prior art known to me. For example, U.S. Pat. No. 3,553,746, issued to Seiger on Jan. 12, 1971, discloses a rigid, generally T-shaped framework adapted to be positioned near a patient's bed or chair. The framework comprises an arm support to be grasped by the person to pull himself up from the bed without assistance. The structural aid proposed by O'Kennedy in U.S. Pat. 3,591,874 issued July 13, 1971 comprises an angular handlebar mounted upon a wheeled platform for supporting a disabled person. The patient grasps the handlebar of the scooter-like device and pulls himself up to a standing position.

However, such devices are impractical for the person who cannot at least temporarily support his full weight on one or both legs. Moreover, some individuals, and in particular those who are large or heavy, lack the necessary flexibility or strength in their arms and back to pull themselves up on a rigid support. Additionally, such devices are not suitable for use as a mobile support or walker, so the patient must subsequently support himself on furniture, walls, or other apparatus in order to move about without assistance. Some mechanical systems suffer from the disadvantage that they cannot "clear" the patients bed properly to readily enable him to stand.

Numerous types of mobile supports or "walkers" are also known in the prior art. King, Pat. No. 4,510,956 issued Apr. 16, 1985 illustrates a wheeled, generally U-shaped framework which surrounds the body of the patient. The patient leans his Weight on cushioned arm supports on either side of the framework and pushes himself forward. Braking spurs may be selectively engaged by manipulation of a hand-operated brake bar associated with the front of the frame. A powered support disclosed by Houston et al., U.S. Pat. No. 4,802,542 issued Feb. 7, 1989 comprises a frame while permits the disabled individuals to move about in a generally upright position. The patient using the Houston et al. device generally does not walk on his own power but is propelled about, much as in a wheelchair, except that the patient is standing.

Such prior art walkers generally do not provide adequate means for assisting the patient from a seated to a raised position. Those who do not have sufficient strength in their arms to support their body weight must have assistance to mount and dismount the walker. Moreover, typical prior art walkers do not provide any power-assist lift means. It is desired to provide an automated device which may be employed to assist a patient to rise from a seated to a standing position and to ambulate comfortably without assistance from others.

U.S. Pat. Pat. No. 3,596,298 issued to Durst, Jr. on Aug. 3, 1971 comprises a wheeled frame adapted to lift the patient from a seated to a standing position. A pair of support stanchions extend vertically upwardly from the wheeled frame and support a body-receptive cage. The body cage includes cushioned arm rests and a cushioned back rest against which the patient may lean. Hydraulic cylinders dynamically couple the stanchions to the frame, and may be activated to move the stanchions and the body cage between the upright position in which the stanchions stand generally perpendicular to the frame to an reclined position, in which the stanchions extend at an angle of roughly forty degrees from the frame. Thus the patient is reclined to facilitate movement in or out of a chair.

Of somewhat more relevance to the instant invention is the motorized lifter/walker disclosed by Thomas, U.S. Pat. No. 3,999,228, issued Dec. 28, 1976. The latter device comprises a large wheeled framework adapted to support a pulley-driven patient hoist. The patient straps himself into a harness associated with the hoist and activates the motor by manipulating a hand control mounted on the frame. The motor drives the pulley, which supports the weight of the patient and gently pulls him to a standing position. Once the patient is standing, he can use the wheeled framework as a walker and move about virtually without assistance from another. This device greatly facilitates the patient's independent movement.

However, there are various disadvantages associated with known prior art devices. Some devices are difficult to balance. Many devices must be adapted to use in restricted-space areas, and passage through residential hallways or doors is often difficult. Some devices cause the patient to suffer considerable discomfort in his back and chest as if they are hoisted vertically upwardly from the torso. Many devices are too cumbersome or too large to adequately clear a mattress or slide under the bed. Many devices lack adequate support structure to permit the patient to walk forward without the assistance of another person.

Thus it is desired to provide a safe, automated lift-assist device which may be comfortably and conveniently used by a wide variety of patients who are partially ambulatory for moving about independent of assistance from others. It is also desired to provide a machine which permits the patient to rise and walk without depending upon another person for help.

SUMMARY OF THE INVENTION

My new patient assist machine enables partially ambulatory, and otherwise incapacitated patients to rise to a standing position and walk or move about. It enables ones legs to be exercised, while safely providing bodily support.

The machine preferably comprises a rigid, wheeled frame which is open at the front to allow the patient easy entry. The frame preferably comprises a base having a pair of rigid side rails. A plurality of caster wheels mounted on the side rails facilitate smooth and quiet movement across the floor. A rigid plate extends across the rear of the frame between the side rails and supports a winch and battery safely isolated under a vented compartment.

A rigid shield extends across the rear of the base to clear the floor of small obstructions as the patient walks. This shield preferably extends down to within one fourth inch from floor and three inches out. It provides an added safety factor to keep the machine from tipping forward. It also functions as a bumper to keep from scarring furniture.

Frame sides comprising opposing pairs of rigid, upright legs extend upwardly from the base. The legs terminate at their upper end in rigid hand rails which the patient may hold to support his weight. A push-handle extending upwardly at the rear of the frame can also be grasped by the standing patient. Where desired, the patient may temporarily suspend a seat or sling between the hand rails so that he can rest his legs for a brief period.

A cushioned, U-shaped yoke is dynamically mounted within the frame interior. The yoke is slipped comfortably against the patient's torso and under the arms to support the patient's weight. For greater comfort, the patient may easily remove the yoke and substitute a yoke which is conformed to his own body proportions.

The yoke may be selectively moved up and down to lift and lower the patient. The yoke is dynamically mounted to the frame by a linkage assembly comprising top and bottom lever assemblies mounted by bearings to the frame sides. The bearings define pivot points for the levers. The top and bottom levers are of different lengths, and their pivot points are offset. Camber control of the yoke results. The pivot point for the bottom lever is adjacent the rear of the frame, and the pivot point for the top lever is offset toward the front of the frame. The offset pivot points result in greater lifting power and stability, and enhance the comfort of the patient using the machine.

When the patient is seated and prepared to be lifted, the yoke is lowered and fitted to the patient. As the patient activates the switch located on the yoke or on the hand rail, a winch-driven cable pulls the linkage assembly upward so that the patient is slowly elevated to his feet. As the yoke moves, the camber or tilt of the yoke varies to accommodate the shifting weight of the patient and enhance the patient's comfort.

The yoke is initially tilted forward toward the patient. During lifting, the yoke first undergoes camber loss until it reaches an intermediate position of maximum negative camber. Thereafter, the yoke experiences camber gain as it lifts the patient to the fully upright position. When the patient is standing, the yoke rests roughly horizontally. If the patient leans forward, the yoke passes greater camber gain and tilts backward toward the rear of the machine, so that it securely holds the patient in place.

The preferred configuration of the frame allows the bottom rails of the machine to roll under a patient's bed, and the top rails easily slide over the top of the mattress. This allows the lifting yoke to slide under the arms of the patient without the patient leaning forward or sitting on the edge of the bed. Since the front, or mattress to the frame is open about half the distance from front to back, it can also straddle a chair or commode in the same manner, thereby lifting or seating a patient who otherwise would need help from one or more aids.

Thus it is a fundamental object of the present invention to assist physically handicapped or partially ambulatory patients to move about.

It is also a basic object to free those bedridden or sedentary patients who have at least partial strength in their legs so that they may walk about.

Another broad object of the present invention is to provide a device which allows a partially ambulatory patient to move about and exercise without assistance from other persons.

Yet another fundamental object of the present invention is to provide a machine which can be comfortably used by a partially ambulatory patient as a lift and as a walker.

A similar basic object of the present invention is to provide an automated device to help a patient rise from a seated to a standing position.

A related object is to provide a machine of the character described which will comfortably approach a bedridden patient's bed and allow him to easily stand.

Another important object is to provide a machine of the character described which will allow some patients to live alone or in their own homes longer, so that they will not be prematurely forced into a nursing home.

A related object of the present invention is to provide an automated assist device which permits a partially ambulatory patient to comfortably rise from a seated position to walk.

A further object is to provide a patient lift device which dynamically responds to changes in the patient's position.

A related object of the present invention is to provide an automated patient assist device of the nature described which incorporates a variable-camber lifting assembly which provides improved balance and greatly enhances patient comfort.

Still another object of the present invention is to provide a walker device which may be comfortably maneuvered through conventional hallways and doors.

Another object is to allow the patient to go outside and move on the sidewalk, or to simply park outside and watch the normal activities around them.

Another object of the present invention is to provide a patient assist device of the character described which may be readily adapted to patients of different sizes.

Yet another object of the present invention is to provide an automated patient assist device of the character described which will comfortably support a patient in a standing position.

A further object is to provide an automated walking device which can be conveniently controlled by the patient.

A still further object is to solve the problem of exercising for certain groups of people who are more or less warehoused in nursing homes. Unfortunately in nursing homes very few patients get enough exercise, and through my machine the problem can be at least somewhat remedied.

Yet another object is to provide a machine of the character described which is appropriately sized and configured so that it will easily go through normal doors and around corners in an ordinary house. It will allow a patient to work with appliances such as cook stoves and refrigerators.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
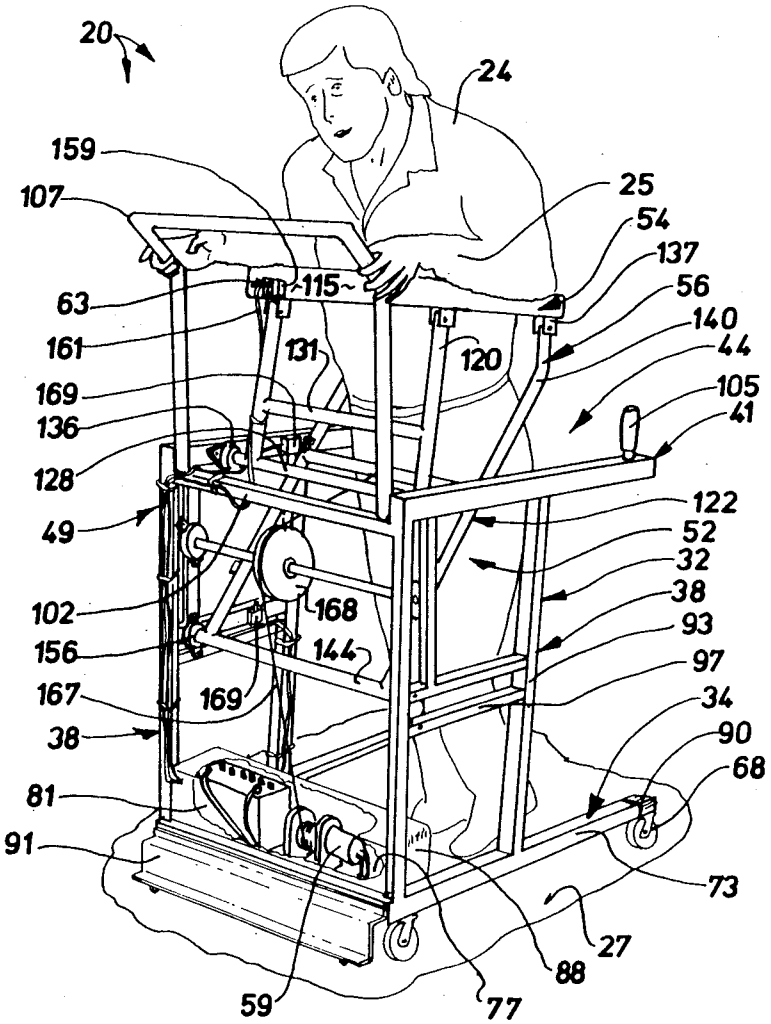
FIG. 1 is a fragmentary perspective view of the preferred embodiment of my new Patient Assist Device, showing a typical patient engaging the yoke and moving about.

With initial reference directed to FIG. 1 of the appended drawings, my patient assist machine has been broadly designated by the reference numeral 20. Machine 20 is ideally adapted for use by a patient 24 for rising to a standing position and walking about on a smooth floor or similar supporting surface 27. As used herein, the term "patient" is broadly used to designate collectively all persons who for a variety of reasons are partially ambulatory, although many such individuals are not institutional "patients" in the strict sense of the word. Such patients are generally able to move about and walk with some assistance, but are unable to support their full body weight on their legs in order to rise up from a bed or chair and walk independently.

Machine 20 broadly comprises a rigid frame 32 having a base 34, a pair of spaced-apart, rigid frame sides 38 extending upwardly from base 34. Each side includes a hand rail 41. The generally U-shaped frame 32 is preferably constructed of lightweight, tubular aluminum stock. The metal parts are preferably coated with a chrome finish to create a clean, unitary appearance.

Frame 32 comprises an open patient-receptive front 44 and a closed rear 49. The frame front 44 defines an access to the interior 52 in which the patient is received. A patient-receptive lifting yoke 54 dynamically mounted by a linkage assembly 56 may be selectively raised and lowered within interior 52 to move the patient between a sitting and a standing position. The linkage assembly 56 is preferably driven by a winch 59 associated with the frame rear 49. Control switches 63 mounted in association with the yoke 54 permit the patient 24 to conveniently activate the machine 20 when he desires to rise or be seated. A plurality of caster wheels 68 mounted on the base 34 suspend machine 20 above floor 27 and permit the patient 24 to comfortably maneuver it as a walker.

The frame side rails easily slip over the top of a mattress and lift under the arms of a patient while the bottom rails slide under the bed so a patient does not need to lean forward on it or sit on the edge of the bed in order to be lifted. The frame is also configured so that the opposing side rails will easily go to each side of a commode or chair, and the yoke will slip under the arms of patient without the patient positioning himself on the edge of the toilet or chair.

Base 34 comprises a pair of rigid rails 73 maintained in parallel, spaced-apart relation by a rigid plate 77 associated with the rear 49 of the frame. Plate 77 mounts the battery 81 and winch 59, which are preferably isolated from contact within a vented compartment 88. Bars 73 are preferably long enough to adequately balance the frame, but must be short enough to permit the patient 24 to maneuver through standard-sized halls and doorways and to comfortably turn corners. The front ends of rails 73 are preferably covered with cushioning caps 90 to prevent injury to the patient and damage to walls and furniture.

A rigid bumper shield 91 extends outwardly away from wheels 68 and downwardly toward floor 27 at the rear of base 34. Shield 91 clears small obstacles from the patient's path. If the patient should lean heavily on the rear of frame 32, shield 91 will also help brace the machine against tipping toward the rear. Shield 91 acts as a bumper and enhances safety. Preferably it is positioned about three inches out in front and extends to within a quarter inch from the floor level to prevent the machine from tipping forward.

A pair of rigid frame sides 38 extends vertically upwardly, perpendicularly from rails 73. Each side 38 comprises a pair of upright legs 93 spaced-apart by a rigid brace 97. A rigid cross piece 102 extends across the upper ends of legs 93. Legs 93 terminate at their upper end in hand rail 41 which extends horizontally from said frame rear to said frame front, in generally parallel relation to rails 73 of base 34. Cushioned handgrips 105 extending vertically upwardly from the front of hand rails 41 may be grasped by the patient for ease in operating machine 20. The frame 34 thus forms a generally U-shaped open interior 52 adapted to receive the patient's body. Extending vertically upwardly from cross piece 102 at the rear 49 of the frame is a generally arcuate push-handle 107 which the patient may grasp while standing and walking with the machine.

Figure 3:
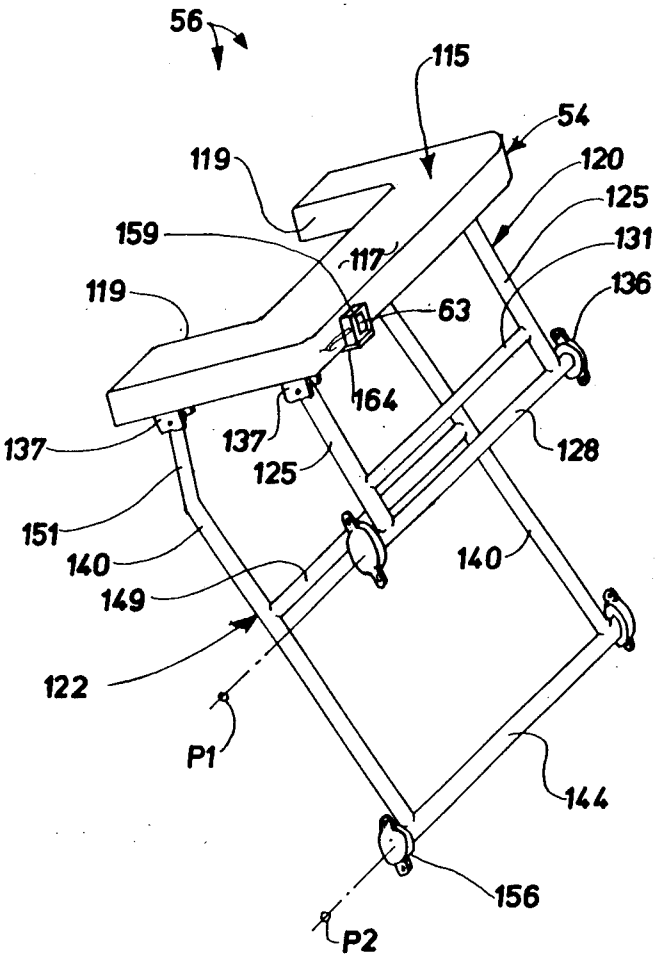
FIG. 3 is an enlarged, fragmentary, side elevational view illustrating the preferred linkage assembly; and, FIG. 4 is a fragmentary, bottom perspective view illustrating the yoke mounting.

With additional reference now to FIG. 3, linkage assembly 56 comprises a patient-receptive yoke 54. Yoke 54 comprises a generally U-shaped cushion 115 having a body 117 adapted to fit about the patient's torso and a pair of spaced-apart front ends 119 which rest under the patient's arms 25. Yoke 54 is dynamically linked to frame 34 for pivotal movement within interior 52 by winch-driven linkage assembly 56.

Figure 2:
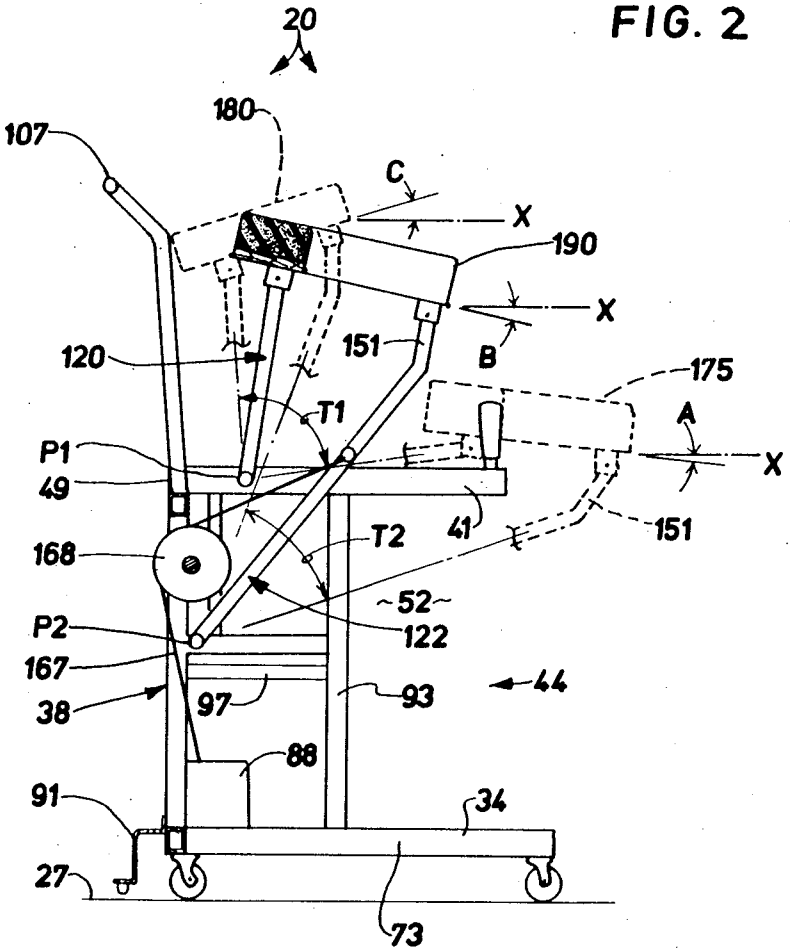
FIG. 2 is an enlarged, fragmentary, side elevational view in which alternate positions of the yoke are illustrated in dashed lines.

Linkage assembly 56 comprises a top lever 120 and a bottom lever 122. Top lever 120 comprises a pair of spaced-apart arms 125 mounted in parallel relation upon a rigid axle 128. The axle 128 terminates at both ends in bearings 136 which are preferably secured to opposite hand rails 41 at the top of frame sides 38 (FIG. 1). As best viewed in FIG. 2, bearings 136 define a first pivot point P1 about which lever 120 rotates. The path of travel of top lever 120 is indicated by arrow T1 (FIG. 2). Arms 125 are pivotally coupled by suitable connectors 137, such as pin-and-collar assemblies (FIG. 4), securely fastened to the underside of yoke 54. A rigid crossbar 131 positioned generally parallel to axle 128 braces lever 120 between axle 128 and cushion body 117.

Bottom lever 122 is similar in construction, comprising a pair of spaced-apart arms 140 mounted in spaced-apart parallel relation upon a rigid axle 144 and braced by a rigid bar 149. Arms 125 of top lever 120 are shorter in length than arms 140 of bottom lever 122. Preferably, top arms 125 are roughly one-half the length of bottom arms 140. Each of bottom arms 140 terminates in an end 151 which extends upwardly from the arm at an angle of roughly forty-five degrees. Ends 151 are also pivotally coupled to the underside of yoke 54 by connectors 137 such as pin-and-collar assemblies or the like. Axle 144 is mounted to frame 32 by bearings 156 secured to side legs 93 at braces 97. As best viewed in FIG. 2, bearings 156 define a second pivot point P2 about which lever 122 pivots. The path of travel of bottom lever 122 within interior 52 is indicated by arrow T2.

The yoke configuration acts as a safety feature whereby the patient, by pushing with his chest on the yoke, transfers the pushing force to the bottom of machine, rather than to the top of machine. Instead of the pushing force being transferred from the user's chest to the machine in a straight horizontal line, which might move the machine too quickly, force will be transferred from a chest high position downward at approximately forty-five degrees, so vector force components will resolve downwardly. Stability is thus increased.

Linkage assembly 56 is preferably cable activated by a conventional electric winch 59. A twelve volt D.C. winch has proven satisfactory, but other types of motors may be substituted. Winch 59 is electrically interconnected to hand-operated control switches 63 mounted within a control box 159 preferably associated with yoke body 117. As best viewed in FIG. 1, insulated electrical wires 161 couple switches 63 to a conventional 12-volt battery 81. Wires 161 are preferably disposed within the interior of legs 93 and extend upwardly through the frame via arms 125 into control box 159. Alternatively, conductors 161 may be routed via hand rails 41 to suitable control switches integrally associated with handgrips 105.

Control box 159 is preferably mounted by a bracket 164 or similar device associated with yoke 54. Cable 167 extends from winch 59, is directed around pulley 168, and preferably terminates in bar 149 associated with bottom lever 122. When the patient activates control switch 63, winch 59 engages to draw cable 167, which moves the linkage assembly 56 up or down.

Preferably one or more limit switches 169 (FIG. 1) are provided to automatically shut off the winch when the yoke 54 has traveled its predefined path. Thus damage to the winch and possible injury to the patient are avoided. Where feasible, a trickle charger may also be incorporated to keep the battery charged, so that the machine is always ready for immediate use.

With additional reference now to FIG. 2, levers 120, 122 of the linkage assembly 56 rotate about pivot points P1 and P2 respectively to move yoke 54 within frame interior 52. Yoke 54 may assume a first, lower position illustrated in dashed lines and designated by the reference numeral 175. This lower position 175 is assumed when the patient is seated and prepared to be lifted. The seated patient draws the machine with the open front toward him and leans forward with his arms 25 upon the yoke. By activating the switch 63, the patient starts the winch which draws the cable to raise the linkage assembly. The patient rests his weight upon the cushion and is slowly elevated to his feet. As the patient rises, he may also grasp the hand rails for a greater sense of stability.

When the patient 24 is lifted to a standing position for walking, yoke 54 preferably assumes an upright, generally horizontal disposition (FIG. 1). The yoke then rests roughly horizontally parallel to hand rail 41 and base rails 73. When the patient is standing as illustrated in FIG. 1, top lever 120 extends straight vertically, perpendicular to hand rail 41 Thus patient 24 stands centered within frame interior 52, comfortably spaced apart from frame 32. In this position, the patient's weight will be borne mainly on the patient's arms and legs, and yoke 54 bears a minimum load.

As the yoke is moved upwardly from and downwardly to position 175, it passes through various intermediate positions, such as that designated as 190. As it ascends from position 175, the cushion 115 tilts toward the front of the frame to accommodate the shifting weight of the patient and provide enhanced comfort. For example, at intermediate position 190, the yoke 54 tilts downwardly toward the frame front.

The uppermost position illustrated in dashed lines and designated by the reference numeral 180 may be assumed when the standing patient leans forward, such as to rest or to reach outside the frame. At the uppermost position 180, lever arm ends 151 point vertically roughly perpendicular to hand rail 41, and the top arms 125 extend angularly toward the rear of frame 32. The cushion ends are tilted upwardly, so that the patient is substantially "held" in the upright position by the yoke. The patient can comfortably rest his chin or shoulders upon cushion body 117 while standing in order to relieve the weight off the arms. Where desired, a removable seat or sling (not shown) may be temporarily suspended between hand rails 41 to allow the patient to elevate his legs for a brief rest.

Thus, as the yoke moves up and down within the frame, it tilts to dynamically respond to the patient's position and enhance the patient's comfort. More specifically, as lever arms 120, 122 pivot, the camber of the cushion varies.

As used herein the term "camber" relates herein to the degree of tilt or angular displacement of the cushion relative to a predefined reference axis. Thus "camber loss" as used herein refers to an inclination in a negative direction relative to the reference, and "camber gain" refers to inclination from the reference in a positive direction. A reference axis X (indicated by broken lines in FIG. 2) horizontally is defined parallel to hand rail 41. Passing downwardly to the first, lower position 175, yoke 54 undergoes a camber loss from zero degrees at X to roughly negative fifteen degrees, indicated as angle A.

As it rises, the yoke undergoes a relatively constant camber loss until it reaches intermediate position 190, roughly two-thirds through its predefined path of travel. At position 190, maximum negative camber of roughly negative twenty degrees, indicated as angle B, is evidenced. As yoke 54 continues rising past position 190, it passes through camber gain from negative twenty to zero degrees at the horizontal position. Camber gain continues until the yoke reaches uppermost position 180, at which the yoke achieves maximum positive camber indicated by angle C, which is roughly positive fifteen degrees.

Importantly, it is noted that pivot point P1 is offset from pivot point P2 toward the frame front 44. Point P1 is spaced roughly five inches from the rear end of hand rail 41 at the top of the frame. Pivot point P2 associated with lower lever 122 is located at brace 97 fully at the rear of the frame. As best viewed in FIG. 3, bottom lever 122 is spaced apart from top lever 120. However, as is evident from consideration of FIG. 4, top and bottom levers 120, 122 are of different lengths and they do not remain in parallel relationship as the linkage assembly 56 pivots within frame 32. The patient's weight is borne mainly by bottom lever 122 during lifting. Thus it is important that the path T2 traveled by bottom lever 122 is substantially shorter than the path T1 of top lever 120. Offsetting pivot points P1 and P2 in this manner thus maximizes the lifting power and stability of machine 20 as well as enhancing patient comfort.

Figure 4:
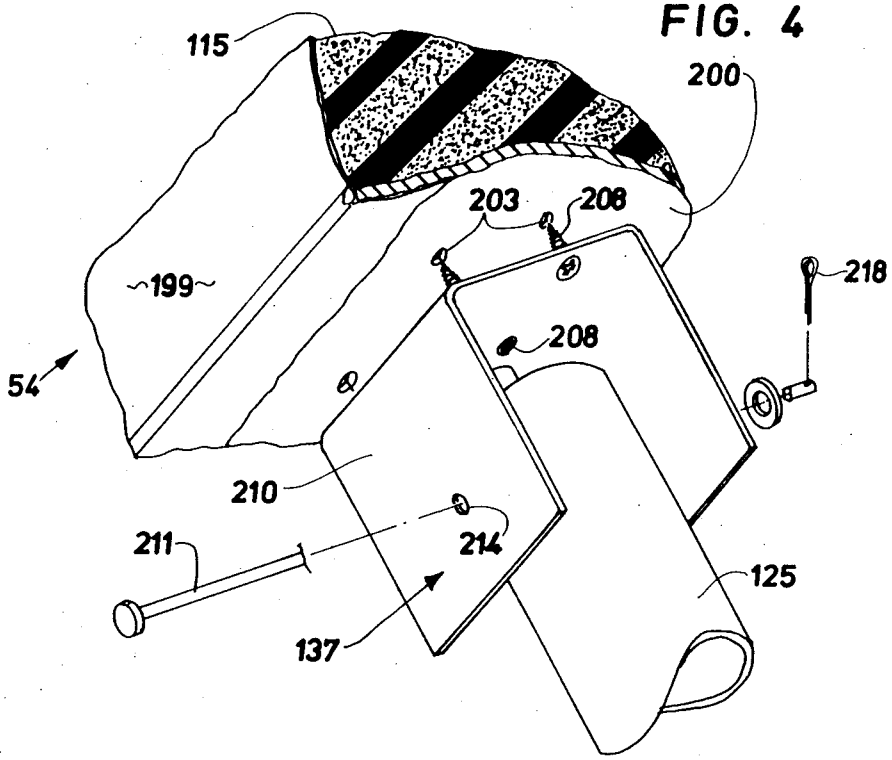

FIG. 4 illustrates how yoke 54 is preferably attached to the linkage assembly 56. Yoke 54 comprises the generally U-shaped cushion 115 comprising polyethylene foam or the like covered with a layer of durable material 199 such as vinyl or terrycloth. Cushion 115 is mounted to a rigid form 200. Form 200 preferably comprises a rigid, unitary sheet of aluminum or steel and is drilled with a plurality of mounting orifices 203. Orifices 203 are penetrated by bolts 208 or other fasteners which permanently mount the form 200 on pivotal connectors 137.

Pivotal connectors 137 preferably comprise rigid brackets 210 adapted to be pivotally mounted to lever arms 125 and 140. A rigid, removable pin 211 penetrates orifices 214 defined through bracket 210 and arm 125 and is secured by a cotter pin 218 or similar fastener. The present construction facilitates the use of interchangeable cushions in order to accommodate patients of different sizes. Simply by removing cotter pin 218 and sliding pin 211 out of the bracket 210, the user may quickly release the cushion 115 from arms 125 and 140. Brackets 210 of the replacement cushion may then be positioned on arms 125 and 140 with orifices 214 in registered alignment. The new cushion may then be pivotally secured thereon by replacing pin 211. Thus a patient may readily adapt the machine for comfortable use by substituting a cushion conformed to his own body.

The overall machine configuration allows the machine to easily approach a bed; the bottom rails roll under the bed and the side rails easily slide over a mattress top. This allows the lifting yoke 54 to slide under the arms of the patient without the patient leaning forward or sitting on the edge of the bed. My machine can also straddle a chair or commode in the same manner, thereby lifting or seating a patient who otherwise would need human assistance.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A mobile machine for assisting a partially ambulatory user to walk or move about, said machine comprising:

frame means, comprising front and rear means, adapted to be disposed upon a supporting surface;

yoke means associated with said frame means for selectively engaging the torso of said user;

linkage means for dynamically coupling said yoke means to said frame means, said linkage means comprising top lever means for coupling said yoke means to a first pivot point defined upon said frame means; bottom lever means for coupling said yoke means to a second pivot point defined upon said frame means, said first pivot point being located above said second pivot point and being offset from said second pivot point towards said frame front means, and the length of said top lever means being less than the length of said bottom lever means; and, motor means disposed upon said frame means for selectively moving said yoke means and consequently said user from a sitting position to a standing position.

2. The machine as defined in claim 1 wherein said frame means comprises hand rail means adjacent said yoke means adapted to be grasped by said user.

3. The machine as defined in claim 2 wherein said frame means comprises:

a rigid base;

a user-receptive front and a spaced-apart rear;

a plurality of wheels secured to said base for suspending said machine; and, a pair of sides extending vertically upwardly from said base, said hand rail means comprising a hand rail associated with each of said sides.

4. The machine as defined in claim 1 wherein said motor means comprises a motor, means coupling said motor means to said linkage means, and battery means for powering said motor.

5. The machine as defined in claim 4 wherein said motor means comprises an electric switch interconnected with said battery means for controlling said motor means.

6. The machine as defined in claim 5 wherein said base means comprises a compartment for storing said battery means.

7. The machine as defined in claim 1 wherein said hand rail means comprises a handgrip associated with each of said frame sides.

8. An automated device for assisting a partially ambulatory person to rise from a seated position to a standing position and to move about independent of support from other persons, said device comprising:

wheeled frame means adapted to be disposed upon a supporting surface, said frame means comprising an open, person-receptive front, a spaced-apart rear, a rigid base, and a pair of spaced apart, rigid sides extending vertically upwardly from said base;

variable camber yoke means for selectively engaging the torso of said person, said yoke means deflectable within said frame means person-receptive front;

linkage means pivotally coupled to said frame for dynamically coupling said yoke means to said device, said linkage means comprising top and bottom levers of different lengths said linkage means further comprising a first pivot point at which said top lever is pivotally coupled to said frame and a second pivot point at which said bottom lever is pivotally coupled to said frame, said first pivot point offset from said second pivot point towards said frame front; and, motor means disposed upon said frame means for selectively elevating and lowering said yoke means.

9. The device as defined in claim 8 including a handgrip associated with each of said frame sides and a push-handle associated with said frame rear.

10. The device as defined in claim 8 comprising interchangeable yoke means for accommodating users of different sizes.

11. The machine as defined in claim 8 wherein said yoke means dynamically responds to changes in the user's position during lifting by passing through camber loss and camber gain as it travels within said frame means.

12. The machine as defined in claim 11 wherein said linkage means moves relative to a predefined reference axis from a first position of negative camber through an intermediate position of maximum negative camber to an uppermost position of maximum positive camber.

13. The machine as defined in claim 12 wherein said first position is defined at roughly negative fifteen degrees, said intermediate position is defined at roughly negative twenty degrees, and is uppermost position is defined at roughly positive fifteen degrees relative to said predefined reference axis.

14. The machine as defined in claim 13 wherein said intermediate position is defined roughly one-third through the path of travel of said linkage means.

* * * * *